United States Patent [19]

Jackson et al.

[11] 4,436,258

[45] Mar. 13, 1984

[54] METHOD OF AND APPARATUS FOR SIMULTANEOUSLY PACKAGING LINEAR BUNDLES OF FILAMENTS INTO INDIVIDUAL PACKAGES

[75] Inventors: Robert R. Jackson, Toledo; Jerome P. Klink, Granville, both of Ohio

[73] Assignee: Owens-Corning Fiberglas Corporation, Toledo, Ohio

[21] Appl. No.: 373,087

[22] Filed: Apr. 29, 1982

[51] Int. Cl.[3] ..... B65H 54/02; B65H 54/20

[52] U.S. Cl. ..... 242/18 G; 242/35.5 R; 242/36

[58] Field of Search ..... 242/18 G, 18 R, 18 A, 242/35.5 R, 36, 39, 49, 57; 57/264, 265

[56] References Cited

U.S. PATENT DOCUMENTS

| | | | |
|---|---|---|---|
| 3,771,324 | 11/1973 | Klink et al. | 242/18 G |
| 3,838,827 | 10/1974 | Klink et al. | 242/18 G |
| 3,897,021 | 7/1975 | Shape | 242/18 G |
| 4,023,741 | 5/1977 | Schar | 242/18 R |
| 4,193,557 | 3/1980 | Melan et al. | 242/18 A |
| 4,294,416 | 10/1981 | Beckman | 242/18 G |

*Primary Examiner*—Stanley N. Gilreath

*Attorney, Agent, or Firm*—Ronald C. Hudgens; Patrick P. Pacella; Ronald E. Champion

[57] ABSTRACT

The disclosure embraces a method of and apparatus for simultaneously winding linear bundles of filaments, such as strands of glass filaments, in a filament-forming operation into two or more packages on a driven rotatable collet and the linear bundles or strands traversed by guide members axially of the packages, the progressively increasing sizes of the packages normally intermittently moving the traverse guide members away from the packages, and wherein an undersized package activates an instrumentality, indication or signal warning the operator of such condition and interrupting movement of the traverse means away from the packages.

9 Claims, 9 Drawing Figures

METHOD OF AND APPARATUS FOR SIMULTANEOUSLY PACKAGING LINEAR BUNDLES OF FILAMENTS INTO INDIVIDUAL PACKAGES

TECHNICAL FIELD

In textile and kindred industries, it has been a practice carried on in forming packages of linear bundles or strands of filaments in filament-forming operations, such as those producing glass filaments gathered into bundles, strands or the like, to wind the packages simultaneously on a rotating instrumentality. In glass filament-forming operations in simultaneously winding packages of linear bundles or strands of filaments, the rotational speed of the packages is progressively reduced as the packages increase in size so that filaments of substantially uniform diameters are produced.

BACKGROUND OF THE INVENTION

In packaging linear bundles or strands of glass it is a practice to traverse the linear bundles of strands lengthwise of the package by traversing or guide members maintained close to the packages so that the linear bundles or strands are substantially uniformly distributed lengthwise of the packages. In order to maintain the guide or traverse members close to the packages, progressive increases in the sizes of the packages being formed are effective to activate means moving the traverse support means laterally by successive increments. In such method, the package size sensing means is activated by the package having the largest diameter. Heretofore if one or more of the packages being formed were undersize, the operator was not aware of such differential in size of the packages being formed.

The invention embraces a method or process in simultaneously winding packages of linear bundles or strands of filaments on a collector involving traversing the linear bundles or strands of filaments lengthwise of the packages wherein an undersize package being formed is effective to activate an instrumentality, indication or signal warning the operation of an undersize condition of a package.

Another object of the invention is the provision of a method or process of simultaneously winding two or more packages of linear bundles or strands of filaments on collectors and traversing the linear bundles or strands of filaments lengthwise of the packages wherein an undersized package which may be formed abnormally is effective to interrupt movement of the traverse means away from the packages.

Another object of the invention resides in an arrangement for simultaneously winding linear bundles of strands or filaments into two or more packages on collector means wherein the linear bundles or strands are distributed lengthwise of the packages by traverse means and the traverse means normally intermittently moved away from the packages as the packages increase in size, the arrangement including an instrumentality, signal or indicating device rendered effective by an undersized package being formed for warning the operator of such undersized package condition.

A further object of the invention resides in an arrangement for simultaneously winding linear bundles or strands of filaments into two or more packages on collector means wherein the linear bundles or strands are distributed lengthwise of the packages by traverse means and the traverse means normally intermittently moved away from the packages as the packages increase in size, the arrangement including means rendered effective by an undersized package being formed for interrupting movement of the traverse means away from the packages.

DESCRIPTION OF THE DRAWINGS

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

DESCRIPTION OF THE INVENTION

The method and apparatus of the invention are illustrated for simultaneously winding linear bundles, strand or elements into packages and particularly for forming and packaging bundles or strands of filaments of heat-softened mineral material, such as glass, and indicating by instrumentalities or size sensing means deviations in the sizes of packages being formed. It is to be understood that the invention may be useful in indicating deviations in size of one or more packages in winding packages of other linear elements or bundles of elements such as yarn, cord or roving.

The invention has particular utility in indicating deviations in the sizes of packages of linear bundles or strands of attenuated filaments of glass by reason of malfunctioning which may result in variations in the diameters of filaments during attenuation such as may be caused by changes in the heat pattern of the stream feeder as temperature variations may result in strands of one group of filaments being of larger diameter than strands of another group and hence the sizes of the packages are not the same during package formation.

Figures 1, 2, 3:
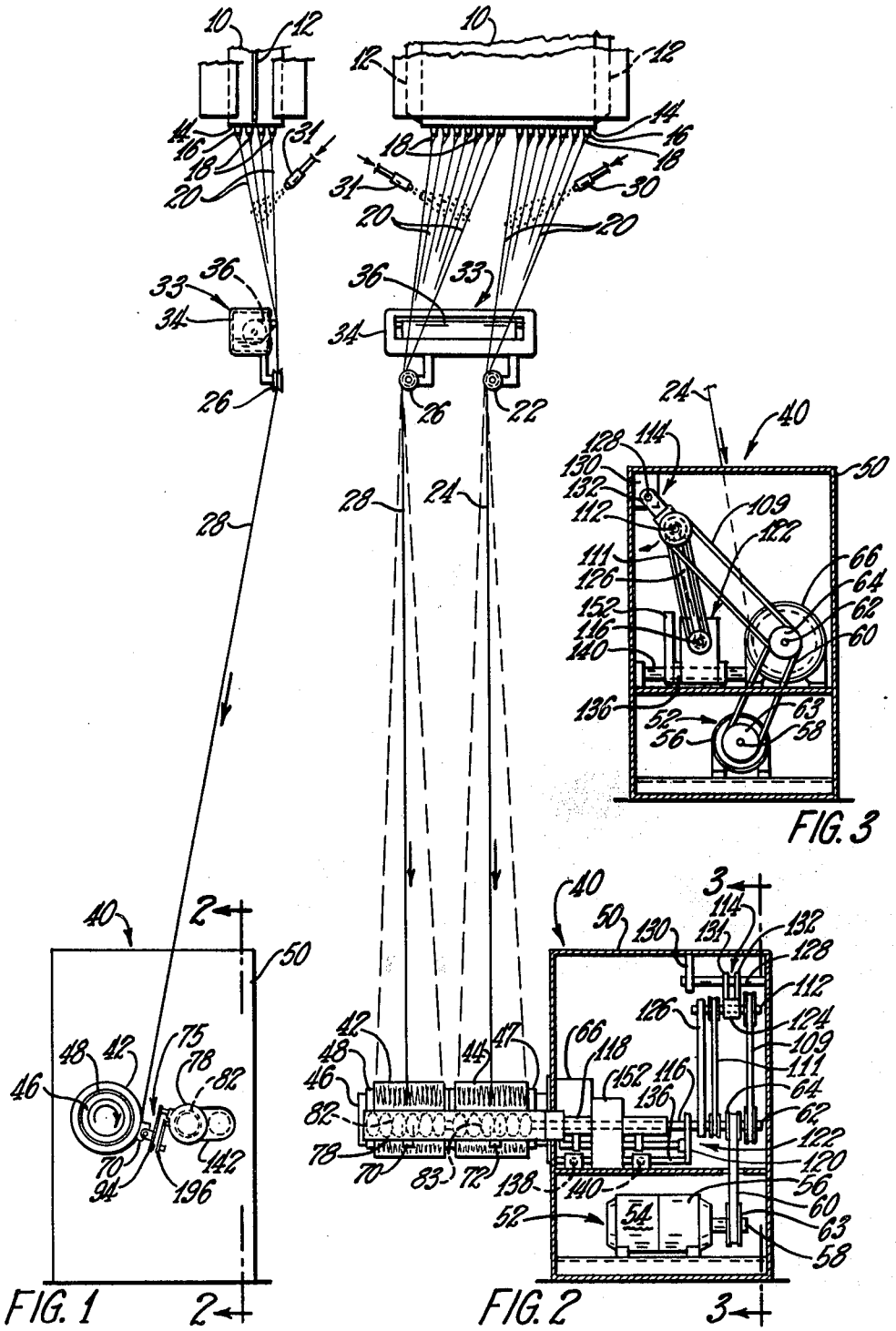
FIG. 1 is a front elevational view of the apparatus according to the principles of the invention wherein two strands of filaments are simultaneously collected into individual wound packages in a glass filament-forming operation.
FIG. 2 is a side elevational view, partly in section, of the arrangement shown in FIG. 1, the view being taken substantially on the line 2—2 of FIG. 1.
FIG. 3 is a sectional view of the winder taken substantially on the line 3—3 of FIG. 2.

Referring initially to FIGS. 1 and 2 of the drawings, there is illustrated a receptacle or stream feeder 10 containing a supply of heat-softened glass or other fiber or filament-forming material. Where the filament-forming material is glass, the feeder 10 may be connected with a forehearth (not shown) supplied with heat-softened glass from a melting furnace, or pieces of glass may be reduced to heat-softened condition in a melter or other means connected with the feeder 10.

The feeder or receptable 10 is provided at its end with terminal lugs 12 arranged to be connected with a source of electric energy for heating the material in the receptacle or feeder to maintain the material at the proper temperature and viscosity for attenuating filaments from the material.

The floor or tip section 14 of the feeder is provided with a large number of depending projections 16 arranged in two groups as shown in FIG. 2, the tips or projections having orifices therein for flowing streams 18 of the glass or other filament-forming material from the feeder. The stream of glass are attenuated into individual continuous filaments 20.

The filaments of one group are converged by a gathering shoe 22 into a linear bundle, element or strand 24, and the second group of filaments is converged by a gathering shoe 26 into a linear bundle, element or strand 28. It is preferable to spray water on the newly formed filaments, and nozzles 30 and 31 are provided for delivering fine sprays of water onto the filaments.

It is a usual practice to apply a liquid sizing or coating onto the filaments in advance of their convergence into linear bundles or strands. Disposed adjacent and above the shoes 22 and 26 is an applicator 33 which includes a housing 34 in which is movably mounted an endless belt 36 or other suitable type of member moving in liquid sizing contained in the housing 34. As the filaments move downwardly, they engage the applicator belt 36 and the sizing liquid is transferred onto the moving filaments.

Disposed beneath the applicator 33 is a winding machine or winder 40 of a character for winding the strands 24 and 28 into two generally cylindrically-shaped wound packages 42 and 44 in end-to-end relation formed on a single rotatable collet 46. The wound packages 42 and 44 are shown as formed on individual forming tubes or sleeves 47 and 48 mounted on the collet 46.

The winding of the linear bundles or strands into packages affects attenuation of the filaments 20 from the glass of the streams 18. The winder 40 includes a housing 50. Disposed within the housing is a variable speed drive mechanism for rotating the collet 46, the variable speed drive mechanism being controlled in a conventional manner to progressively reduce the winding speed of the collet as the packages 42 and 44 increase in size.

The variable speed drive includes a motor and clutch assembly 52. This assembly includes a constant speed electric motor 54 and an eddy-current clutch 56. The motor 54 drives a rotor of the clutch means 56 which has an output shaft 58. A nonslipping endless belt 60 rotates a collet drive shaft 62 through engagement with pulleys 63 and 64 mounted respectively on the shafts 58 and 62. The shaft 62 rotates the collet 46, the collet being rotatably mounted by a bearing mounting assembly 66.

Magnetic forces generated within the eddy-current clutch 56 transfer rotational energy of the motor-driven rotor of the clutch to the output shaft 58. Changes in flux density in the eddy-current clutch vary the amount of rotational energy transferred from the rotor to the output shaft, and, in this manner, the rotational speed of the collet 46 may be varied. The eddy-current clutch arrangement 56 is conventional, and, through such arrangement, the rotative speed of the collet 46 is progressively reduced as the packages increase in size. Such a control arrangement is disclosed in the U.S. Pat. No. 3,897,021 to Shape.

Traversing apparatus is provided for traversing the linear elements, bodies, linear bundles or strands for moving the advancing elements, bodies or strands respectively back and forth lengthwise of the collet 46 in the formation of individual packages 42 and 44, the reciprocating motion imparted to the linear elements. bodies or strands distributing them on the packages. The strand traversing apparatus includes identical element or strand-engaging traversing guides or members 70 and 72.

Figure 4:
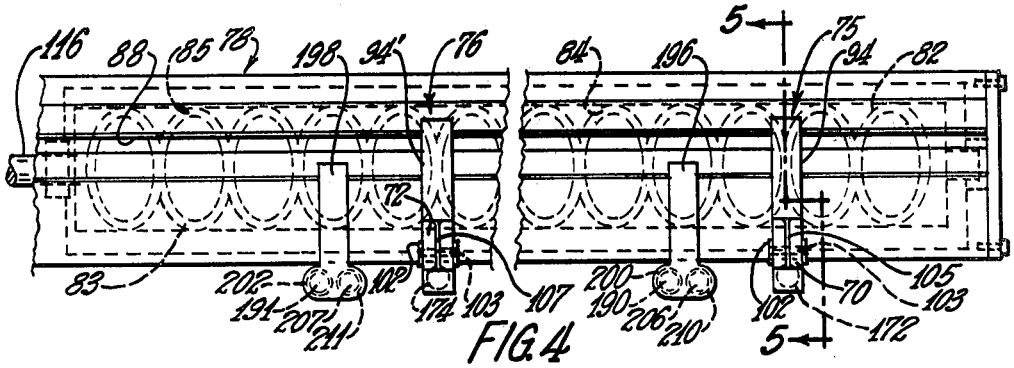
FIG. 4 is a front elevational view of the strand traversing means carried on a movably mounted support housing.
Figure 5:
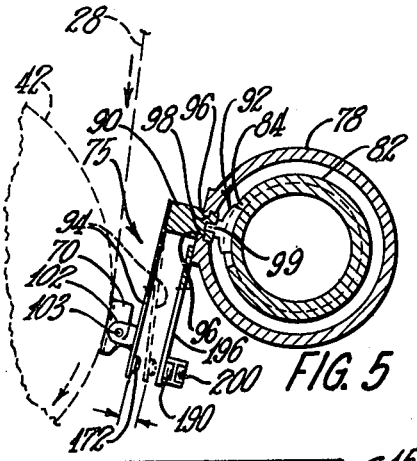
FIG. 5 is a sectional view of the strand traversing means, the view being taken substantially on the line 5—5 of FIG. 4.
Figure 6:
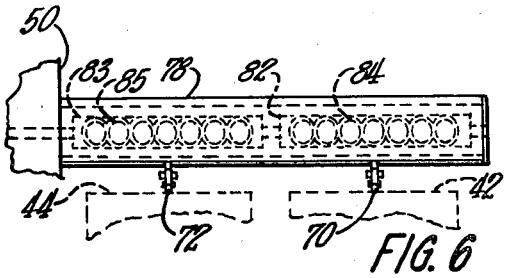
FIG. 6 is a plan view of the strand traversing arrangement of the winder shown in FIGS. 4 and 5.

Referring more particularly to FIGS. 4, 5 and 6, the element or strand traversing means includes substantially identical traversing assemblies 75 and 76 which include the strand engaging guides 70 and 72 at the circumferential surfaces of the packages and a relatively movable tubular housing 78 carrying the guide assemblies 75 and 76 for movement lengthwise of the collet 46. The tubular support housing 78 is disposed horizontally with its longitudinal axis extending in a direction parallel with the axis of rotation of the collet 46.

Means is provided for reciprocating the strand guide assemblies 75 and 76 including the element or strand guides 70 and 72. This means comprises substantially identical multiple return grooved or barrel cams 82 and 83 rotatably mounted within the tubular support housing 78. The barrel cams 82 and 83 are coaxially connected members having multiple return grooves 84 and 85, respectively.

The strand guide assemblies 75 and 76 are slidably mounted upon the tubular support housing 78. The tubular support housing 78 is provided with a lenghtwise extending slot 88 which accommodates slidable movement of the strand guide assemblies. The slot 88 is open substantially the entire length of the tubular housing 78 on the side of the housing facing the collet 46. The strand guide assembly 75, as shown in FIGS. 4 and 5, includes a slide block 90, a cam follower 92, and elongated flat spring 94 and the strand guide 70. The strand guide assembly 76 is of substantially the same construction.

The slide block 90 includes grooves 96 that accommodate lengthwise edge portions 98 defining the slot 88. The edge portions 98 provide guide ways fitting into the grooves 96 in a sliding fit relationship. The cam follower 92 provides an operative connection of the slide block 90 with the cam grooves 84 of the barrel cam 82. The cam follower 92 includes an arcuate portion that fits into the cam grooves 84 and a tenon 99 pivotally mounted in a bore in the slide block 90.

During operation the pivotal connection of the follower 92 with the slide block 90 accommodates swivel or pivotal movement of the follower 92 at the reversal regions of the multiple return groove. The slide block 90 carries the flat or plate spring 94 which depends from the block 90. As shown in FIGS. 4 and 5, the lower end of the flat spring 94 is fashioned with projections or portions 102. Pivoted to the projections 102 by a pin 103 is a strand guide and traverse member 70 which engages the periphery of the adjacent enlarging package being formed on the collet.

The strand traversing assembly 76 is inclusive of identical components above described and which includes the second strand guide 72 shown in FIGS. 4 and 6. Each of the strand guides 70 and 72 has a flat guide surface fashioned with a recess or slot indicated at 105 in the guide 70 and indicated at 107 in the guide 72. The guide slots accommodate respectively the linear bundles of filaments, elements or strands 24 and 28 being wound into packages.

In operation, each of the strand guide assemblies 75 and 76 including the strand guides 70 and 72 are reciprocated axially of the collet on which two packages are being formed, the guides 70 and 72 being lightly pressed under the influence of the springs 94 and 94' against the circumferential surfaces of the respective packages being formed.

Rotation of the multiple return groove cams 82 and 83 reciprocates the strand guide assemblies along the slot 88, the speed of reciprocation of the guides being directly proportionate to the rotational speed of the grooved or barrel cams. The multiple grooved or barrel cams are rotated from the collet drive shaft 62 through nonslipping belts 109 and 111. The belt 109 connects the collet drive shaft 62 and a rotatably mounted idler shaft 112 of an idler assembly 114.

The belt 111 connects the idler shaft 112 with a cam drive shaft 116 that drives the cams 82 and 83. The drive shaft 116 is rotatably mounted by a bearing support assembly 118 and a vertical end plate 120 of a movable carriage 112 shown in FIGS. 2 and 3. The carriage 122 is movable horizontally within the winder housing 50 and the cam support housing 78 is carried for horizontal movement by the carriage 122. The idler assembly 114 permits movement of the carriage 122 without affecting the drive belts 109 and 111.

The idler assembly 114 includes the rotatable shaft 112, a bearing box 124, a position arm 126, support member 128 and support bracket 130. The support member 128 and the bracket 130 support the bearing box 124 and the shaft 112 above the carriage 122. The bearing box 124 is movable about the axis of the support member 128 by swingable legs or members 131 and 132.

The position arm or strut 126 connects the shaft 112 and cam drive shaft 116 to maintain the shafts at a constant spaced distance. The position arm or strut 126 maintains the shaft 112 and the idler assembly in proper relation relative to the carriage 122 as the carriage 122 is moved toward and away from the collet 46. The swinging movement of the idler assembly 114 about the support member or shaft 128 maintains the endless belts 109 and 111 in proper driving or engaging relationship on their respective sheaves or pulleys.

The carriage 122 includes a base member 136 secured to the vertical end plate 120. The carriage 122 is slidably mounted upon two horizontally-spaced parallel support rods 138 and 140 fixedly supported within the winding machine housing 50. These rods extend through passageways in the base 136, the rods extending in a direction perpendicular or normal to the axis of the collet 46. The winding machine frame or housing 50 is fashioned with an elongated opening 142 which accommodates horizontal movement of the tubular support housing 78.

Figure 7:
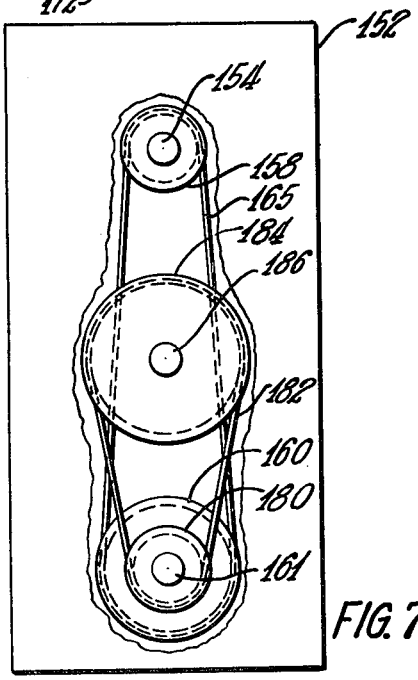
FIG. 7 is a front elevational view of the driving means in the winder housing for moving the strand traverse assembly support and controls.
Figure 8:
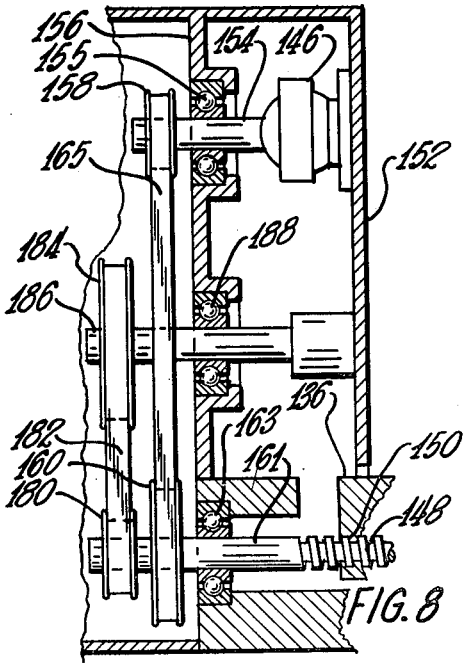
FIG. 8 is a side elevational view, partly in section, of the apparatus shown in FIG. 7.

The winding machine or winder 40 includes drive mechanism to move the carriage 122 and the tubular support member 78 during formation of the packages to maintain the element or strand guides 70 and 72 at the circumferential surfaces of the packages 42 and 44, respectively. Referring to FIGS. 7 and 8, the drive includes a motor 146 adapted to rotate a threaded shaft or drive screw 148 in a threaded passageway 150 of the carriage base 136.

The motor 146 is supported within a control box 152. The motor shaft 154 is journaled in bearings 155 mounted by a wall portion 156 of the control box 152. The motor shaft 154 is equipped with a sheave or pulley 158, and the drive screw or shaft 148 is provided with a sheave or pulley 160 mounted upon an unthreaded portion 161 of the drive screw 148. The unthreaded portion 161 of the drive screw 148 is journaled in bearings 163 by the base member 136.

An endless drive belt 165 engages the sheaves 158 and 160 to transfer rotation of the motor shaft 154 to the drive screw 148. Rotation of the motor 146 effects rotation of the drive screw or threaded shaft 148 to move the carriage 122 laterally of the packages in successive increments as the packages increase in size.

The motor 146 is a comparatively slow speed motor, a type which is commercially available, such as a SLO-SYN made by the Superior Electric Company. Winder controls energize the motor 146 to move the carriage 122 during formation of the packages to maintain the strand guides 70 and 72 at the circumferential surfaces of the packages 42 and 44.

To accomplish this, the progressively increasing sizes of the packages on the collet are sensed, and intermittently there is supplied an indication of the size of the largest among the packages being formed in response to the intermittently supplied indication of the size of the largest package, and the tubular support housing 78 is moved by the energized motor 126 a small distance transversely away from the collet 46.

This movement of the tubular support housing 78 is intermittent depending upon the enlargement of the largest of the packages being formed so that the strand guides 70 and 72 are maintained substantially at the circumferential surfaces of the packages.

The winder 40 includes controls effective in response to the sensed size of the largest of the packages at any time to modify the rotational speed of the collet 46 while maintaining a substantially uniform rate of strand or element collection during formation of the packages. A typical circuit for accomplishing this is shown and described in the U.S. Pat. No. 3,897,021 to Shape, herein incorporated by reference.

Figure 9:
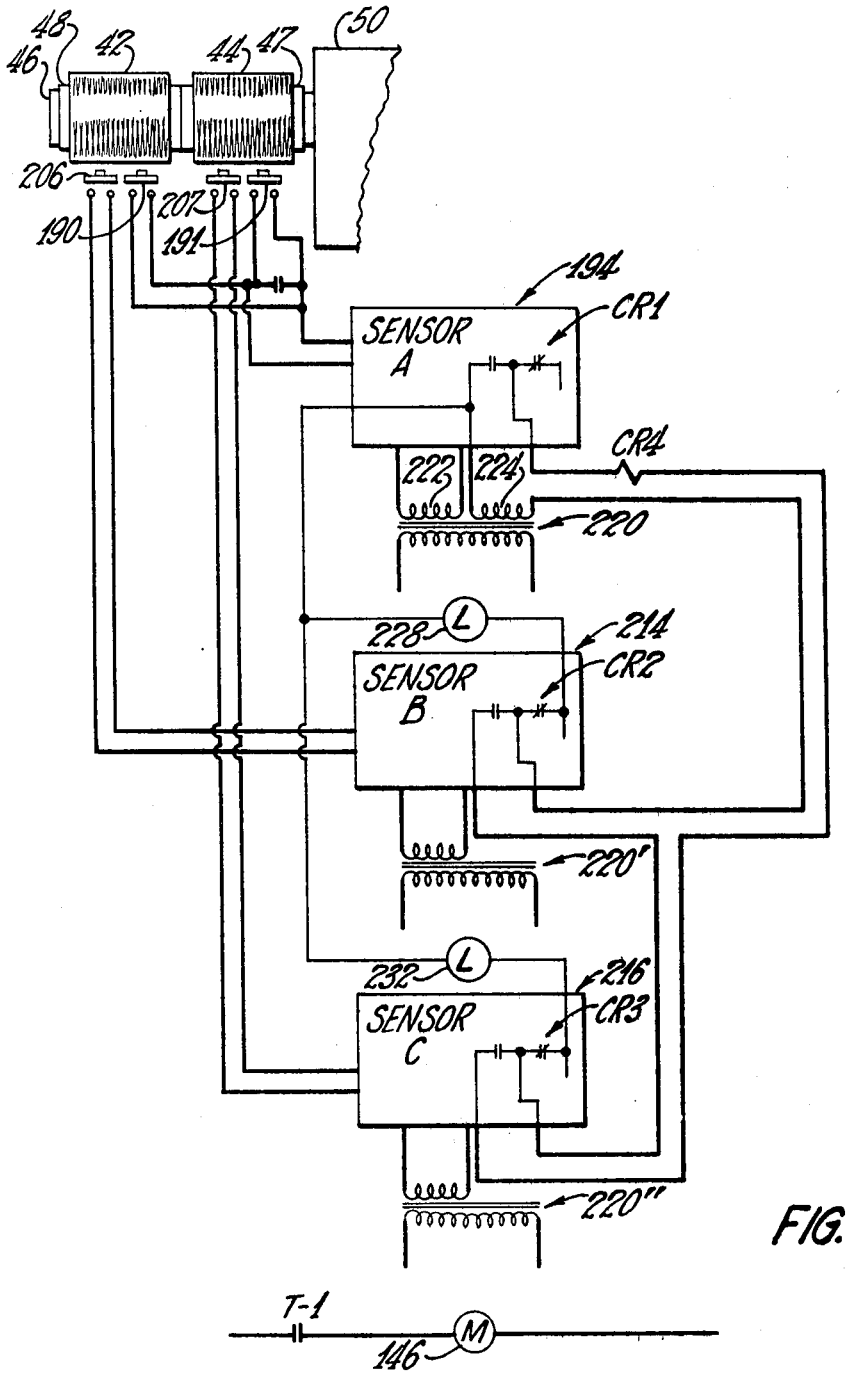
FIG. 9 is a circuit diagram of the control arrangement for the traverse mechanism.

The designation 194 in FIG. 9 embodies a control circuit system shown and described in the U.S. Pat. No. 3,897,021 to Shape, for controlling the operation of the package winding motor 56 as well as the circuit control sensing means for moving the tube 78 and associated components away from the packages as they are increased in size.

The control circuit system of FIG. 9 includes a potentiometer (not shown) which is activated as the package increases in size to control the eddy-current clutch mechanism 56 for progressively reducing the speed of the collet as the package increases in size so that the elements or strands are being wound into a package at a substantially constant linear speed.

The electrical energized motor 146 rotates the drive screw 148 which effects movement of the slider (not shown) within the potentiometer. The shaft 161 is equipped with a sheave 180 engaged by a belt 182 driving a sheave 184 on an auxiliary shaft or slider control shaft 186 mounted in bearings 188 supported by the housing or control box 152. Thus, rotational movement of the drive screw 148 controls the output of the potentiometer in the control box 52 in addition to effecting movement of the carriage 122.

When the tubular support housing 78 is at its package start location, the potentiometer in the control box 152 is set or adjusted to a position that effects a maximum collet rotational speed, that is, maximum flux in the eddy-current clutch in the housing 56. The motor 146 rotates the drive screw 148 during package formation, and such movement effects rotational movement of the potentiometer control shaft 186.

The invention is inclusive of auxiliary or secondary sensing means which activates an instrumentality, indication or signal in event one or more of the packages being formed is of a lesser diameter than that of the largest package being formed. This indication that there is a differential in size of packages being simultaneously formed informs the operator of a malfunctioning in the operation.

The malfunctioning may reside in nonuniform heating of the bushing or the glass within the bushing where one group of filaments or certain of the filaments of a group may be lesser or greater than normal size or other possible temperature malfunction which may affect the size of the filaments of the elements or strands being wound into the respective packages.

The means for sensing the sizes of the packages for effecting and controlling intermittent movement of the strand guides as the packages increase in size includes two switches and switch activating devices for each of the packages being formed. Each of the switches is in a circuit system that controls the flow of electric energy to the traverse control motor 146.

Each of these dual size sensing arrangements for the packages is substantially identical. The arrangements include a normally-open, magnetically-actuated reed switch for each package, the switches being designated respectively 190 and 191. The reed switches 190 and 191 control the circuit means of the circuit system 194, these switches simultaneously sensing the enlargement of the respective packages 42 and 44.

The switch members 190 and 191 are mounted respectively on elevated support members 196 and 198 fixedly secured to the tubular housing 78 enclosing the member equipped with the traversing cams 82 and 83. The switch mechanism 190 and 191 include natural magnets 200 and 202 which are employed to actuate the contacts respectively of the reed switches 190 and 191. Cooperating with the natural magnetic switches 190 and 191 are natural magnetic members 172 and 174 mounted respectively upon the plate springs 94 and 94'.

As shown in the circuit diagram in FIG. 9, the switch contacts 190 and 191 are connected with a package size sensing means or sensor "A" which is normally connected by conventional circuit means with the motor 146 through a relay CR4.

During the formation of packages 42 and 44, they are progressively enlarged in diameter and, if of the same size, the magnets on the plates 94 and 94' move away from the packages at equal distances and the switches 190 and 191 closed to energize a timer (not shown) which closes timer contact T-1 activating a relay CR4 to energize motor 146 momentarily moving the traverse mechanism or assembly including the housing 78 and traversing assemblies 75 and 76 a short distance away from the packages.

After a short period of time, the timer times out limiting the momentary movement of the traverse mechanism or assembly. This movement away from the packages releases the tension on the spring plates 94 and 94' to move switch members 190 and 191 away from the magnets 172 and 174. Thereafter, no further movement of switches 190 and 191 will be effected by the magnets until the packages are further enlarged and the switches 190 and 191 are again moved by the magnets to circuit closing position.

The winding continues and as the packages increase in size, the traverse assembly will be moved in intermittently comparatively short periods transversely away from the packages. The invention includes a method and arrangement comprising a second set or group of magnetically-actuated switches for providing an indication or signal in the event that any one of the packages being formed is undersized or is not normally increasing in size with another package or packages.

Mounted on the support members 196 and 198 are magnetically-actuated switches 206 and 207 of the same character as the magnetically-actuated switches 190 and 191. Natural magnets 210 and 211 are disposed respectively adjacent the switch means 206 and 207. As will be noted from FIG. 4, the switches 190 and 206 are mounted by the single support member 196, and the switches 191 and 207 are mounted by the single support member 198.

The switch means 206 is connected with the sensor circuit system or unit 214 which is energized by a closing of the switch 206. The closing of switch 206 does not affect the operation of the circuit system 194 (sensor "A") because if package 42 is progressing in size at the proper rate, both switches 190 and 206 will be actuated. However, in the event that package 42 is enlarged in size at a lesser rate than package 44, the magnet 172 adjacent the lesser diameter package 42 will not be moved outwardly sufficiently to actuate the switch 206. That is, the switches 206 and 207 are preset on their respective supports 196 and 198 for actuation of either of them when the size of the package it senses is predetermined lesser size than the largest package sensed by switches 190 and 191.

If switch 206 is not actuated, the circuit system 214 (sensor "B") being connected with the package size circuit system 194 (sensor "A") renders the motor 146 de-energized through the relay CR4 so that the traverse mechanism will not move laterally away from the packages even though the switch 191 is closed by pressure of the larger of the two packages. In such condition, with the switch 206 not being closed because of the undersize of package 42, the current relay CR2 is not energized and, therefore, interrupts current flow to the package size sensing system 194, thus interrupting the back-off movement of the traverse support tube 78 and the element or strand traversing components carried thereby.

Simultaneously with this interruption of back-off movement of the traverse mechanism away from the package, an indication such as an electrically energized signal lamp or other instrumentality 228 is energized through the circuit system 214 thus providing an indication or warning to the operator of a malfunction in the winding of the package 42 that the package is undersized.

The package size sensing circuit system 216 is adapted to provide an indication, signal or warning that package 44 being wound is undersize. In event that the package 44 is not increasing progressively in size at the rate of package 42, the traverse member or guide 72 is not outwardly stressing the plate 94' forming a component of the traversing assembly 76 with sufficient pressure to close the switch 207.

Thus, the package size sensing circuit system 216 is not energized, a contact of current relay CR3 is open, and the circuit to the primary package sensing circuit or system 194 is not energized. Hence, the motor 146 is not energized and the tubular support 78 and the components of the traversing mechanism are not moved away from the packages. Simultaneously with the occurrence of this condition, an indication, signal or instrumentality 232 which may be an electrically energizable lamp or other instrumentality is activated, thus warning the operator that the package 44 is not increasing at the normal rate and is undersized.

The package size sensing means and control system 194 is supplied with current from a transformer 220. The same transformer in association with package size sensor circuits 214 and 216, for purposes of illustration in FIG. 9, is identified as 220' and 220''. The secondary winding 222 supplies low voltage current, for example 12 volts, to the timer (not shown) which times the periods of backing off movements of the traverse means by the motor 146. The secondary 224 of the transformer supplies low voltage current for operating the motor 146.

The sensor circuit 194 includes a relay CR1 for controlling current flow in the circuit of relay CR4 when the packages being formed are progressively increasing in size at the same rate.

The electrically-energizable signal or instrumentality 228 is connected between the left-hand terminal of secondary coil 224 and a contact of relay CR2. When the package 42 being wound in an undersized condition and relay CR2 is not activated, the signal or instrumentality 228 is energized to warn the operator that package 42 being formed is undersized, current flow to relay CR4 being interrupted by relay CR4 causing the motor 146 to be de-energized, and, hence, the support tube 78 and associated components of the traverse mechanism are not moved laterally or backed away.

The signal or instrumentality 232 is connected to the left-hand terminal of the secondary coil 224 and with the relay CR3 forming a component of the control circuit 216. Thus, when package 44 being wound is not progressively increasing in size at the proper rate and is undersized, the switch 207 is not closed, and relay CR3 interrupts flow of current to the relay CR4, thus interrupting the rotation of the motor 146 and preventing backing off movement of the tube support 78 and the traverse mechanism carried thereby.

The foregoing described arrangement provides a substantially instantaneous indication or warning to the operator that a malfunction is occurring in connection with the winding of a package as the undersized condition of such package prevents closing of the size sensing switch adjacent the particular package.

When all of the packages are being formed at a substantially uniformly progressive increase in size, all of the switches 190, 191, 206 and 207 will be intermittently energized as the packages increase in size so that normal pullback movement of the tubular support 78 and the traverse assemblies carried thereby occurs until the timer contact T1 of the timer associated with the circuit system 194 times out and opens the relay CR4 to interrupt electric current flow to the traverse back-off motor 146.

Through the use of the method and arrangement of the invention, an indication or signal means is provided in the event that one of a plurality of packages being simultaneously wound on a collet is of lesser size warning the operator that an undersized package is being formed and the particular package which is undersized being indicated by the signal means. Such signal means will be activated when the pressure of the package becoming undersized does not exert sufficient pressure upon the plate spring to cause the magnet thereon to activate the size sensing switch.

As the switch adjacent to the undersized package is not activated, the motor 146 for operating the backing off movement of the traverse assembly is not energized so that backing off movements of the traverse assembly are interrupted by reason of an undersized package being formed. It is to be understood that while the method and arrangement of the invention are described as utilized with two independent packages of bundles of filaments, strands or elements being simultaneously wound on a collet, more than two packages may be formed on a collet with additional sensing switches therefor associated with sensing circuits for all of the packages.

It is apparent that, within the scope of the invention, modifications and different arrangements may be made other than as herein disclosed, and the present disclosure is illustrative merely, the invention comprehending all variations thereof.

We claim:

1. The method of simultaneously winding linear elements into more than one package including advancing a plurality of linear elements, forming the advancing linear elements into more than one wound package each rotated at the same angular speed, intermittently supplying indications of the size of the packages being wound at a normal increase in the sizes of the several packages, and indicating a deviation in said normal increase in size of any of the packages when any of the packages have a predetermined lesser size than the largest package.

2. The method of simultaneously winding linear bundles of fibers into more than one package, including advancing a plurality of linear bundles of fibers, forming the advancing linear bundles of fibers into more than one wound package each rotated at the same angular speed, intermittently supplying an indication of the size of the largest among all of the packages during their formation, and energizing an instrumentality responsive to the smallest among the packages being smaller than a predetermined difference in size between the largest package and the smallest package.

3. Apparatus for simultaneously winding linear elements into more than one package including means for supplying a plurality of linear elements, means for forming the linear elements into more than one wound package each rotated at the same angular speed, means for reciprocating a traversing assembly for each of the packages, each of the assemblies including a guide member for each of the linear elements at the circumferential surface of its associated package, a movable support carrying the traverse assemblies for movement laterally of the packages as the packages increase in size during their formation, means normally responsive to the largest of the packages for moving the support intermittently laterally by increments to maintain the traverse guide members at the circumferential surfaces of the packages, and means responsive to an undersized package for interrupting lateral movement of the traverse assembly support.

4. Apparatus as defined in claim 3 including means responsive to an undersized package activating a signal indicating the formation of an undersized package.

5. Apparatus for simultaneously winding multifilament linear elements into individual packages comprising a rotatable collet means upon which multifilament linear elements are wound into individual packages in adjacent end-to-end relationship, means for rotating the collet means, a traversing assembly for each of the packages to distribute the linear elements lengthwise of the respective packages, a guide member for each element mounted by each traverse assembly, a support mounting the traverse assemblies, said support being movable laterally of the packages, means responsive to the relative size of the packages for intermittently moving the support laterally as the packages increase in size, the support moving means including an electric motor, an electric circuit system for supplying electric current to the motor, dual switch means in the circuit system for each of the packages for controlling the operation of the electric motor, said switches for said packages being arranged to be activated by the packages when all of the packages are proportionately increasing in size at the same rate to energize the motor to move the guide members away from each of the packages when all packages have a similar size, said switches in the circuit system being arranged whereby a package which has a dissimilar size fails to activate one of the switches thereby to interrupt the current supply to the motor and interrupt lateral movement of the support.

6. The apparatus of claim 5 in which said means responsive to the size of the packages are switches activated under the influence of the pressure against the guide members.

7. The apparatus according to claim 6, including a permanent magnet associated with each guide member, each of said switch means having a permanent magnet associated therewith, said switches being closed when the permanent magnet carried by each guide member is in close proximity to a magnet associated with each of said switches.

8. The method of simultaneously winding linear elements into more than one package including the steps of:

(a) advancing a plurality of linear elements;
(b) collecting the linear elements into discrete bundles of elements;
(c) guiding each bundle of elements with separate guide means;
(d) traversing each of the guide means axially across a face of a winder collet to form wound packages;
(e) detecting the diameter of each wound package;
(f) periodically retracting all of the traversing guide means when all wound package diameters are similar, to maintain a constant pressure of all of the guide means against the wound package; and
(g) interrupting the retraction of all of the guide means and activating warning indicators when the diameters of the wound packages are not similar.

9. The method of simultaneously winding linear elements into more than one package, including the steps of:

(a) advancing a plurality of linear elements;
(b) collecting the linear elements into separate bundles of linear elements, one bundle for each package to be wound;
(c) guiding each bundle of linear elements with a separate guide means;
(d) simultaneously traversing each guide means in a spaced apart relationship axially in a reciprocating manner across the face of a winder collet to form more than one wound package;
(e) rotating the winder collet at a constantly decreasing rotational speed to maintain a constant linear speed of the bundles of linear elements being wound;
(f) detecting the relative diameters of each package being wound by means of sensors;
(g) comparing the diameters of each package being wound on the winder collet;
(h) periodically retracting all of the guide means away from the wound packages when all wound package diameters are similar; and
(i) interrupting the retraction of all of the guide means and activating warning indicators when the diameters of the wound packages are not similar.

* * * * *